United States Patent [19]

Sebastian

[11] 4,373,281

[45] Feb. 15, 1983

[54] DEVICE FOR DISPLAYING INDICIA

[76] Inventor: James A. Sebastian, 24 Pinecrest Dr., Hastings-on-Hudson, N.Y. 10706

[21] Appl. No.: 167,333

[22] Filed: Jul. 9, 1980

Related U.S. Application Data

[60] Division of Ser. No. 870,636, Jan. 19, 1978, Pat. No. 4,221,064, which is a continuation of Ser. No. 675,966, Apr. 12, 1976, abandoned.

[51] Int. Cl.[3] ..... G09F 11/00; G09F 11/04; A63F 1/18; A63B 71/00

[52] U.S. Cl. ..... 40/491; 40/495; 273/142 D; 273/153 S; 273/144 B; 434/404; 434/405

[58] Field of Search ..... 40/491, 495, 409, 510, 40/509, 508, 109, 1; 273/155, 142 R, 142 H, 153 S, 143 A, 144 B, 142 D, 145 C, 142 J; 46/111, 112, 119; 434/405, 404, 402

[56] References Cited

U.S. PATENT DOCUMENTS

| | | | |
|---|---|---|---|
| 386,577 | 7/1888 | DeGrain | 273/145 C |
| 584,219 | 6/1897 | DeGrain | 273/142 H |
| 979,923 | 12/1910 | Boore | 273/153 |
| 1,114,267 | 10/1914 | Jones | 40/437 |
| 1,172,360 | 2/1916 | Hildburgh | 40/491 |
| 1,518,889 | 12/1924 | Wooster | 273/153 |
| 1,905,846 | 4/1933 | Furedi | 40/109 |
| 1,974,901 | 9/1934 | Stadler | 35/31 |
| 2,216,526 | 10/1940 | Watson | 273/144 B |
| 2,441,261 | 5/1948 | Eaton | 235/89 |
| 2,499,329 | 2/1950 | Potter | 40/109 |
| 2,755,577 | 7/1956 | Greensfelder | 273/155 |
| 2,976,045 | 3/1961 | Mason | 273/142 H |
| 2,985,453 | 5/1961 | Matisz | 273/145 C |
| 3,134,540 | 5/1964 | Shiepe | 235/89 |
| 3,242,602 | 3/1966 | Stern et al. | 50/109 |
| 3,255,661 | 6/1966 | Marban | 350/4.2 |
| 3,372,867 | 3/1968 | Braun | 235/89 |
| 3,435,541 | 4/1969 | Tacey | 35/31 |
| 3,491,471 | 1/1970 | Semple | 40/16 |
| 3,820,792 | 6/1974 | Woodall, Jr. | 273/145 C |
| 3,842,523 | 10/1974 | Yumoto | 40/491 |
| 3,848,504 | 11/1974 | Ingham | 46/193 |
| 3,936,966 | 2/1976 | Zieske | 40/109 |
| 3,984,107 | 10/1976 | Nelson | 40/109 |
| 4,036,503 | 7/1977 | Golick | 273/153 |
| 4,221,064 | 9/1980 | Sebastian | 40/491 |
| 4,231,634 | 11/1980 | Gantz et al. | 350/4.2 |

FOREIGN PATENT DOCUMENTS

| | | | |
|---|---|---|---|
| 280528 | 11/1914 | Fed. Rep. of Germany | 40/109 |
| 365164 | 9/1906 | France | 40/109 |
| 826269 | 3/1938 | France | 40/111 |
| 428611 | 12/1947 | Italy | 235/69 |
| 29172 | 8/1903 | Switzerland | 40/109 |
| 441752 | 1/1936 | United Kingdom | 40/109 |

*Primary Examiner*—Robert Peshock
*Assistant Examiner*—Michael J. Foycik, Jr.
*Attorney, Agent, or Firm*—Kenyon & Kenyon

[57] ABSTRACT

A device for displaying indicia is provided comprising:

(a) at least one cover member having at least one visual display means on at least one surface thereof; and (b) at least one display member slidably movable by gravity with respect to at least one of said cover members within a predetermined area underlying said cover member, said display member having at least one prepositioned indicium on at least one surface thereof, said indicium registering with at least one of said visual display means, whereby said display member slidably changes position with respect to said cover member under the force of gravity in response to rotation of said device in a substantially vertical plane to change the registry of said indicium with respect to said visual display means.

In preferred embodiments of this invention a perpetual and yearly calendar is provided.

17 Claims, 17 Drawing Figures

DEVICE FOR DISPLAYING INDICIA

This is a division of application Ser. No. 870,636, filed Jan. 19, 1978, now U.S. Pat. No. 4,221,064, which is a continuation of application Ser. No. 675,966, filed Apr. 12, 1976 and now abandoned.

BACKGROUND OF THE INVENTION

This invention is concerned with a device for displaying indicia in the form of symbols, colors, pictures, words and other visual representations. The device can also be used for displaying storing and dispensing articles.

In the past, many devices have been described for displaying predetermined indicia such as letters or numbers or combinations thereof. Exemplary of these devices are yearly and perpetual calendars which generally comprise a fixed or movable cover having a plurality of apertures spaced apart from one another beneath which a card bearing predetermined date numbers and month or weekday titles is mounted and can be movable or stationary with respect to the cover. By moving the card or cover, the correct dates of any given year, (year, month, day of the week, day of the month) are displayed through the apertures. Such devices are described for example in U.S. Pat. Nos. 1,429,096; 2,499,329; 2,768,459; 1,373,744; 2,668,382; 2,009,630; and 3,800,454.

These prior art devices are generally characterized in that the card is movable, slidably or otherwise, with respect to the cover or the cover with respect to the card in either one or two directions, as for example solely horizontally or solely vertically, and that the user of the device must himself move the card or the cover in the proper direction and the proper distance to expose the predetermined display on the card through the apertures. This is generally accomplished by pulling a tab connected to the card or by inserting an instrument into a slot on the card and shifting the card or moving the cover over the card, or by operating a simple gear mechanism which engages the card or cover. Moreover, in the case of devices such as perpetual calendars the overall design of the card and cover is relatively complicated. The apertures must generally be divided into year apertures, month apertures, week apertures and day apertures in order to display all the information arranged on the card.

The present invention however provides a device for displaying indicia in the form of symbols, colors, words, pictures and other visual representations including articles to be dispensed from the device, which device is simple in design and requires that the user merely rotate the device in a substantially vertical plane to display and to change the indicia. No sliding, pulling, gear movement or any other means for moving any element of the device is required.

SUMMARY OF THE INVENTION

The device of this invention generally comprises:

(a) at least one cover member having at least one visual display means on at least one surface thereof; and (b) at least one display member slidably movable by gravity with respect to one of said cover members within a predetermined area underlying said one cover member, said display member having at least one prepositioned indicium on at least one surface thereof, said indicium registering with at least one of said display means when said device is positioned in a substantially vertical plane, and whereby said display member slidably changes position with respect to said cover member under the force of gravity in response to rotation of said device in a substantially vertical plane to change the registry of said indicium with respect to said visual display means.

In the preferred embodiments of this invention, the display device can be adapted for use as a perpetual or yearly calendar.

The perpetual calendar embodiment of this invention comprises two substantially planar fixed cover members in the shape of a square having a plurality of apertures arranged in a seven by seven square matrix on each of their surfaces. Disposed between the cover members within a square area under the seven by seven square matrix of apertures on each cover member is a planar insert or display member in the shape of a square having sides shorter in length than the sides of the square area. Associated with one of the cover members and located on the inner surface thereof is a slide groove or runner which runs along the perimeter of the square area and also acts as a spacer between the cover members. By virtue of the insert's having relatively smaller dimensions than the square area and the free space between cover members provided by the spacer, the insert is slidably movable by gravity with respect to the cover members and can shift position when the device is rotated in a substantially vertical plane, the slide groove or runner serving as guiding and limiting means for the movement. The insert contains on each of its sides date integers and letters corresponding to the seven days of the week arranged in a single square matrix having dimensions of 14×14 (rows and columns). The orientation of the integers and letters with respect to each other vary (i.e., inverted, facing left, facing right and in line with each other). However, within each 14×14 square matrix arrangement on one side of the insert are 4 distinct sets of 7 weekday letters and 31 date integers arranged in 4–7×7 matrices, and on the opposite side 3 distinct sets of 7 weekday letters and 31 date integers arranged in 3–7×7 matrices. The distance (center to center) between each consecutive row and column of each distinct set is equal to the distance (center to center) between apertures on the cover member such that each distinct set will be capable of registering with and being displayed through the 7×7 matrix of apertures of one cover member when the device is placed in any of four predetermined positions in a substantially vertical plane. A distinct set can be viewed on the insert in its correct orientation by reading alternate columns and rows of the 14 ×14 matrix when the insert is held in a substantially vertical plane with one edge of the insert in an upper horizontal line. By rotating the insert 90° in each of three steps the other 3 distinct 7×7 sets of date integers and weekday letters can be viewed on one side of the insert. On the opposite side of the insert are 3-distinct sets of 7×7 matrices corresponding to three positions of rotation of the insert. The weekday letters, S, M, T, W, T, F, S, are arranged along the outer perimeter of each edge of each side of the insert and therefore occupies the first row of each distinct matrix set. The 31 date integers occupy the remaining rows and columns of each distinct set. However the first date integer 1 in each distinct set is under a different column headed by a weekday letter in each set. Since the first day of any given month can only begin on one of seven different days of the week, there are seven distinct sets of 31 date integers and 7 weekday letters arranged for any month of any year on both sides of the insert. One side of the insert contains 4 distinct sets of 31 date integers and 7 week letters and the other side contains 3 distinct sets of 31 date integers and weekday letters. The space required for one set of date integers and weekday letters are eliminated on one of the sides of the insert. Since the calendar contains 31 date integers in each set, any date integers between the actual numbers of days of the month to be displayed and 31 are disregarded by the user.

In using the device, it is first necessary to determine the day of the week on which any date of the month to be displayed falls, as for example the day of the week on which a given month begins. The device is then held in a substantially vertical plane with one edge of the cover member in an uppermost horizontal line. A row of week day letters on the insert will appear in registery with the top row of apertures of the 7×7 square matrix on the cover member. The next row on the cover member will show a row of date integers beginning with one and not exceeding 7 in a row. The number 1 in that row will appear below a column headed by one of the seven weekday letters. If date 1 of the month, for example, does not appear below the weekday letter corresponding to the correct day of the week on which the month begins, the device is rotated clockwise in a substantially vertical plane, viewing both sides, through an angle equal to 90°. Because the insert is dimensionally smaller than the area between the cover members rotation of the device clockwise 90° will cause the insert to slide by gravity a distance equal to the distance (center to center) between consecutive rows or columns of the 14×14 matrix toward the lower most edge of the cover member. The top row of the seven apertures of the cover member appearing after rotation will again display the weekday letters of the month but date integer 1 will appear under a different weekday letter column than in the previous positioning of the device. The user continues the process of rotating and positioning the device in a substantially vertical plane viewing both sides of the device until the correct date integer appears below the correct weekday letter column, and the calendar is then set for that month. From there on after a change in the month the user rotates the device as described above clockwise in steps of 90° until the new month is correctly displayed with the first day of the month corresponding to the correct week day letter.

In another embodiment of this invention, a yearly calendar is provided which has the same structural elements as the perpetual calendar, viz a pair of square cover members having a 7×7 matrix of apertures thereon and a square insert slidably movable within a predetermined square area between the cover members and having a 14×14 square matrix arrangement of indicia on each side of the insert. Operation of the yearly calendar is similar to the perpetual calendar; that is, by rotating the device in a substantially vertical plane to provide movement of the slidable insert by gravity toward the lower edge of the cover member to effect a display. The yearly calendar differs in the arrangement of indicia on the insert however, in that there is 1 distinct set of weekday letters and date integers and 3 distinct sets of date integers alone on each side of the insert, each set arranged in a 7×7 matrix. Each side of the insert covers a 6 month period. The date integers in a distinct set begin under a column corresponding to the correct day of the week of the month and the number of date integers which occupy the rows and columns correspond to the correct days of the month of the year the calendar is to measure. In addition an abbreviation of the month name i.e. *Jan* is displayed above the first date numeral of each month. However, since there are 49 positions for date integers in a 7×7 matrix, (42 in each when the 7 weekday letters are subtracted), a part of the succeeding month can also be displayed in each set with the first day of the succeeding month being under the correct weekday letter column. The succeeding distinct sets of 7×7 matrices will then carry over remainders of the date integers of the previous month and will be displayed through the cover apertures as the device is rotated in each of four steps, each step equal to a rotation of the device 90° clockwise in a substantially vertical plane. Since the total arrangement of indicia in each side is the form of a 14×14 square matrix, the total number of positions in each arrangement on each side is 196. Since there are 181 days from January 1 to June 30, (182 in a leap year) plus 7 weekday letters in one distinct set totalling 188 or 189, the first side of the insert covers the first six months of the year and the second side of the insert covers the second six months of the year (July 1 to December 31). A row of weekly letters appears in only one distinct matrix set on each side of the insert corresponding to the first month of each side, January and July. Since these weekday letters are in their traditional calendar positions, S M T W T F S they are not displayed again on subsequent rotations of the device.

The yearly calendar is not limited to displaying a given month by clockwise rotation. By designing the indicia on the insert accordingly it can also effect displays by counter-clockwise movements.

The present invention is not limited to the specific applications of a perpetual or yearly calendar. The indicia on the insert can be varied in kind and arrangement to cover a multitude of useful applications. For example the insert can contain on one or both of its surfaces a predetermined arrangement of photographs, caricatures, geometrical shapes, graphics, designs, colors, letters, numerals, abstract designs or other visual representations so that when the device is rotated a changing, visual display appears through the apertures by each rotation. For example, the device can be used to employ a sequence of numerals or letters useful for educational purposes such as a conversion table or a multiplication table, or a sequence of colors and shades thereof for artistic, aesthetic, or advertising purposes or for providing educational displays such as reading matter or an illustrated story. The indicia as used herein can also be the absence of a distant visual representation as for example a blank space. The device can also be used for storing and dispensing articles such as lipsticks and cigarettes, cosmetics and the like by making the display member or insert three dimensional and arranging the insert with compartments for housing these articles. As the device is rotated these articles will register with the apertures and can be removed therethrough. Rotation again can serve to change the registry of the articles with the apertures to remove the articles from view. Moreover the device need not be rotated by hand. A mechanical, electrical or other automatic means of rotation can also be used. The important feature of this invention is that the insert be slidably movable by gravity with respect to one or more cover members on rotating the device in a substantially vertical plane the insert moving within a predetermined area underlying one of the cover members. The cover members may be opaque or transparent and may also contain graphics, information etc. or other indicia on each surface thereof.

There is no limitation as to the size and shape of the cover member(s) or slidable insert with respect to each other. In this regard the cover member and insert can be in the shape of any figure such as a convex regular polygons i.e. triangle, pentagon, hexagon and convex circular figures such as a circle, "doughnut" or oval or concave and irregular figures. As used herein the term convex figure means a closed figure bounded by straight or curved lines wherein any line connecting any two points within the figure also lies totally within the figure. In a concave figure, at least a segment of the line lies outside the figure. It is not critical in this invention that there be two cover members. One cover member can be employed with the insert slidably disposed beneath it, as for example engaging a slide groove located on the cover which groove surrounds the predetermined area. The means for displaying the indicia are also not limited to apertures or holes in the cover member. Instead of discrete apertures the display means can be made of a prismatic translucent material such as glass which allows viewing of the indicia when the device is held at a certain angle to a light source. The cover member may be transparent if desired and the insert opaque or vice versa. It is also not necessary that a plurality of apertures be used or that they be arranged in a matrix. At least one aperture or other display means can be used to display the indicia which aperture can be varied in size and number.

The insert or display member also need not be a single unit. Multiple inserts can also be employed which can also be slidably movable with respect to each other. The predetermined area on which the insert slides can take the form of one of the cover members, i.e. a square area under a square cover member or can be different in form such as circular, triangular or any other regular or irregular closed figure. The area need not be limited to planar areas, but can also be curved or dimensional.

The guide means is also not limited to a groove or runner. Any other means for limiting the movement of the insert or display member can be employed such as screws or pegs positioned at predetermined positions on the cover member or a raised ridge around the predetermined area can also be employed.

Although the preferred display device of this invention comprises at least one fixed cover member as previously described overlying a display member slidably movable with respect to the cover member, the device can also be designed so that the cover member is slidably movable within a predetermined area overlying a fixed display member. The cover member moves into predetermined positions by slidably engaging guide means associated with said display member surrounding said predetermined area to change the registry of indicia with the display means on the cover member.

In order to more fully describe the present invention, reference will be made to the drawings.

DETAILED DESCRIPTION OF THE PREFERRED EMBODIMENTS

Figure 1:
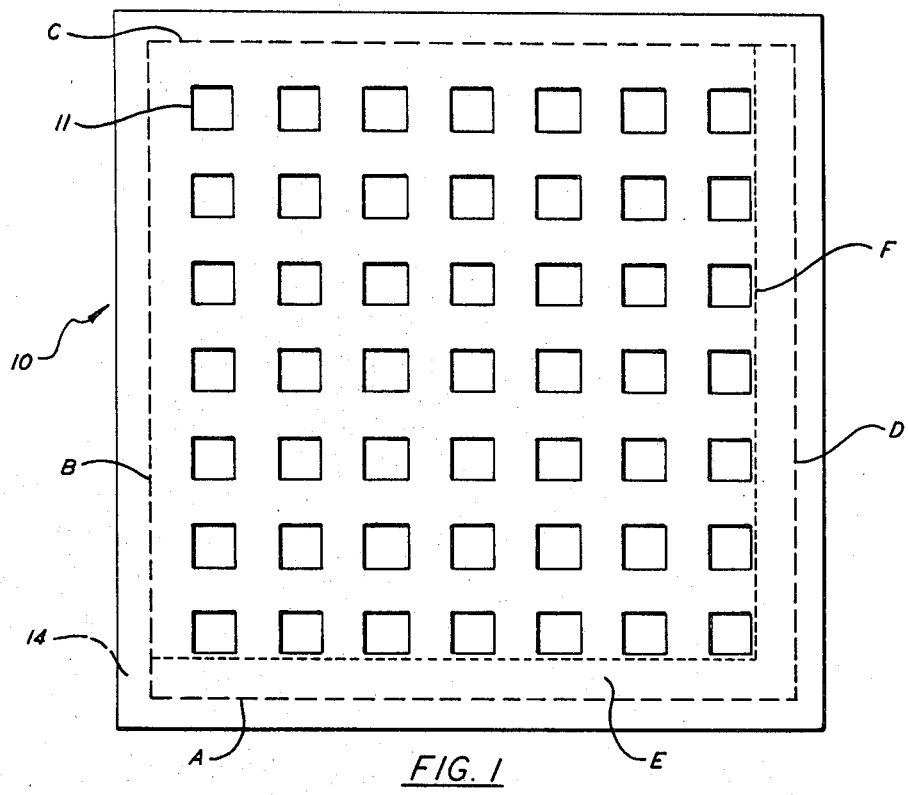
FIG. 1 shows a front view of one cover member of the perpetual calendar embodiment of this invention.
Figure 2:
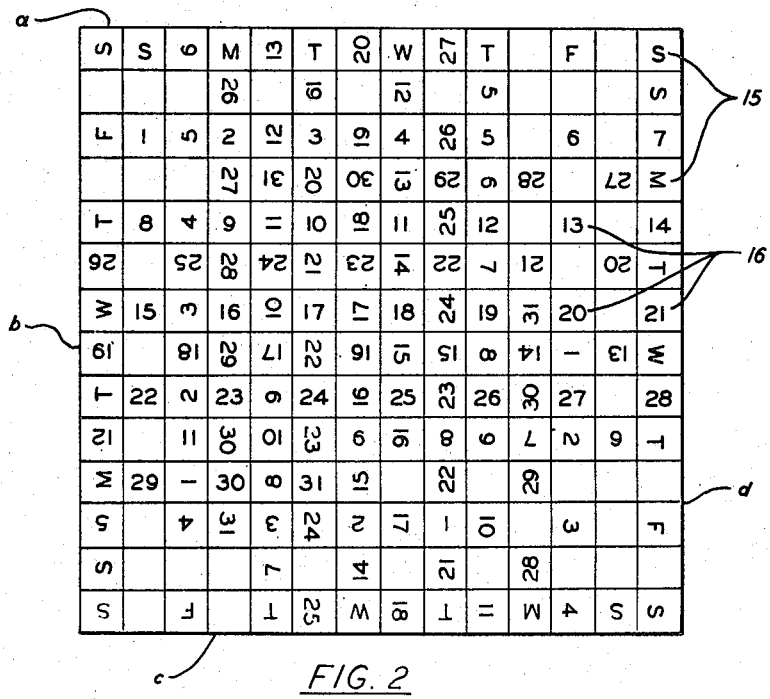
FIG. 2 shows one side of a slidable insert for the perpetual calendar having a first predetermined arrangement of date integers and weekday letters in a 14×14 square matrix on the surface thereof.
Figure 3:
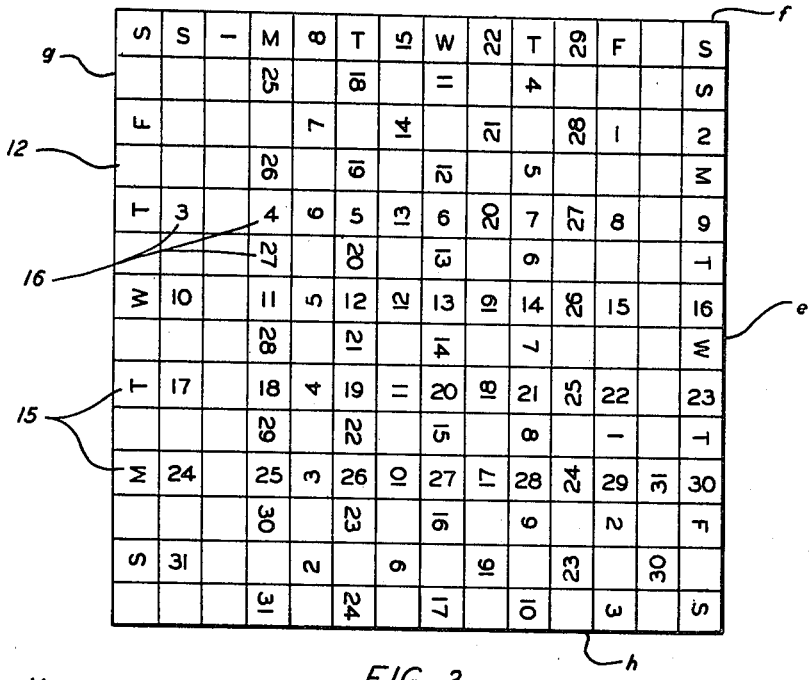
FIG. 3 shows the opposite side of the slidable insert of FIG. 2 having a second predetermined arrangement of date integers and weekday letters in a 14×14 square matrix on the surface thereof.
Figure 4:
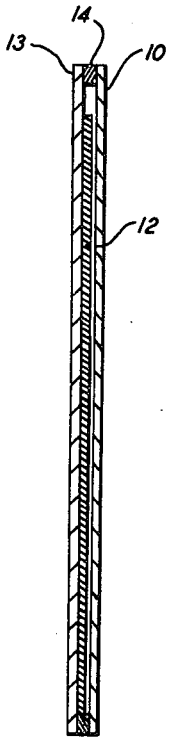
FIG. 4 shows a side view of the perpetual calendar.

In FIGS. 1 and 4 a square cover member 10 is shown having a 7×7 square matrix of apertures 11 centered on the cover member. The cover member 10 can be made of paper, cardboard, plastic, metal, wood or many other solid materials. A second cover member 13 is fixed to cover member 10 directly under cover member 10 (see FIG. 4) having its 7×7 square matrix of apertures in registry with the apertures of cover member 10 and is therefore not seen in FIG. 1. The cover members are spaced apart by a spacer 14 which is associated with one of the cover members. The spacer 14 is essentially a thin strip of solid material which defines a narrow void area between the cover members having sides A, B, C and D. FIG. 2 shows one side of a slidable insert 12 and FIG. 3 shows the opposite side of insert 12. The insert 12 fits within the void area between the cover members 10 and 13 and occupies an area in FIG. 1 having sides BCEF as indicated by the inner dotted lines. The insert is therefore slidably movable with respect to the cover members within the void area. The insert can be made of paper, cardboard, plastic, metal, or the like. Thus in its combined form the device comprises a sandwich of two cover members with the insert 12 slidably movable between them.

Each surface of insert 12 as shown in FIGS. 2 and 3 contains an arrangement of weekday letters 15 and date integers 16 in a 14×14 square matrix. Although the orientations of date integers and weekday letters in the 14×14 matrix vary, i.e., upside down facing left to right, there are 4 distinct sets of 7 weekday letters and 31 date integers in the total arrangement on one side of the insert (FIG. 2) and 3 distinct sets of 7 weekday letters and 31 date integers on the other side of the insert (FIG. 3). These sets are arranged in 7×7 matrices and can be logically viewed as rows and columns in four distinct orientations on the insert, each of these orientations corresponding to four positional rotations of 90° in a vertical plane in which each edge or side of the insert occupies an upper horizontal position with respect to the vertical plane. In FIG. 2, side a occupies the upper horizontal position and thus a matrix of 7 rows and 7 columns can be viewed from left to right and downward from alternate rows and columns of the 14×14 matrix in which the first row is a series of weekday letters and the succeeding rows and columns are occupied by 31 date integers.

For example in FIG. 2 a set of 7 weekday letters, S, M, T, W, T, F, S appears from left to right in the first row in alternate columns of the 14×14 matrix. In the next six alternate rows a sequence of 31 date integers appear under the 7 columns defined by the weekday letters. In FIG. 2 the date integer 1 lies below the first column headed by S (Sunday). By rotating the insert in a vertical plane clockwise 90° to place side b in an upper horizontal line another distinct set of 7 weekday letters and 31 date numerals can be read in alternate rows and columns of the 14×14 matrix in which date integer 1 is below M (Monday). In the orientation in which side c is the uppermost horizontal line, data numeral 1 is below T (Tuesday) and in the orientation in which side d is in the uppermost horizontal position numeral 1 is below W (Wednesday). Thus on one side of the insert 4 distinct sets of weekday letters and date integers are arranged, in which the first day of a month begins on 4 different days of the week, S, M, T, W. On the opposite side of insert 12 as shown in FIG. 3 there are three distinct sets of 7 weekday letters and 31 date integers corresponding to the orientation of the insert in which sides e, f, g of the insert are each separately disposed along an upper horizontal line, and in which the date integers 1 lie under T (Thursday, side e uppermost), (Friday, side f uppermost) and S (Saturday, side g uppermost) respectively.

Since there are only 7 days in a week there are only 7 months which can exist having its first day beginning on a different day of the week. Therefore since there are 8 sides to both surfaces of the insert, only 7 sides are needed to project a distinct set. Therefore orientation h, of FIG. 3 does not contain a distinct set of weekday letters and integers.

Figure 5A:
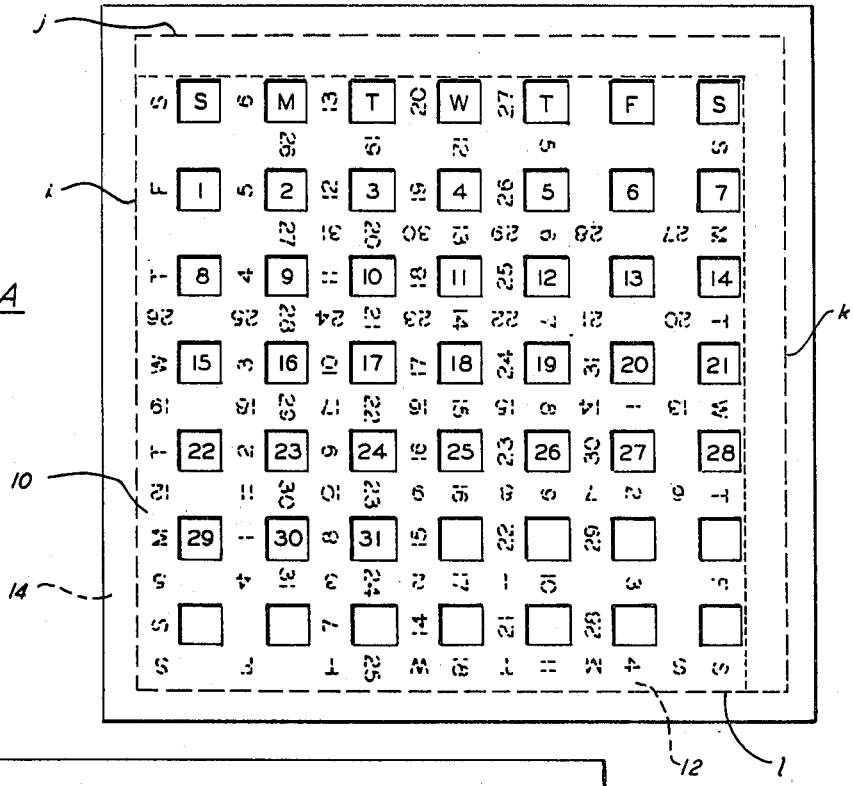
FIGS. 5A and 5B show a stepwise operation of the perpetual calendar and the corresponding date and week displays for each stepwise rotation.
Figure 5B:
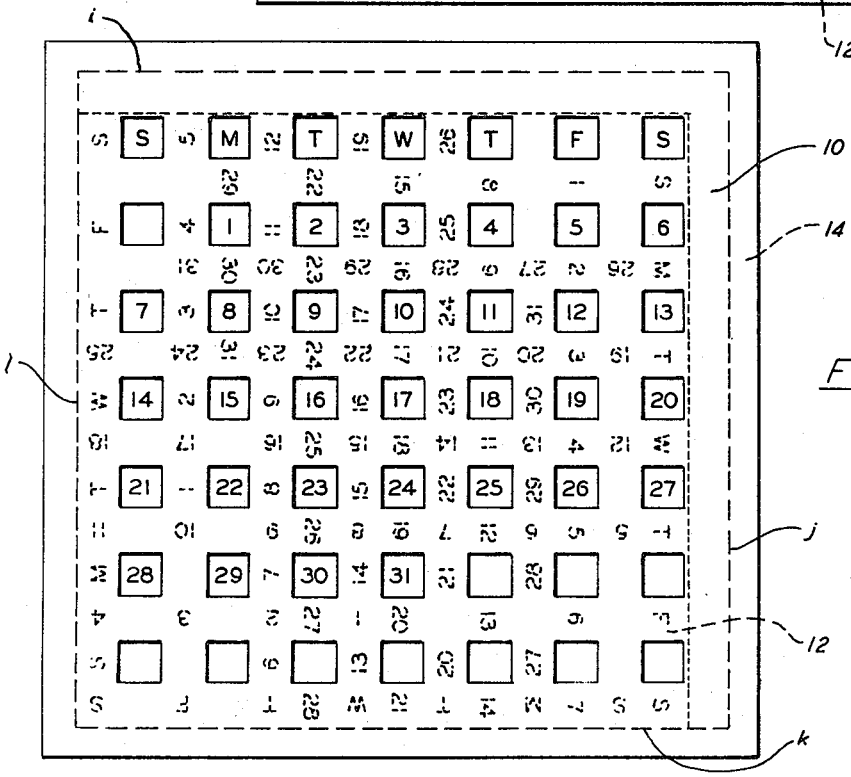

FIGS. 5A and 5B show the operation of the perpetual calendar embodiment viewing one side of insert 12 through cover member 10. The cover member 10 is shown as being transparent to illustrate the relative positions of the date integers and weekday letters on the insert 12 beneath it. The sides of the spacer 14 are indicated by i, j, k and l.

In FIG. 5A, the insert fits into the angle defined by sides i and l of the spacer 14. A 31 day month beginning on a Sunday appears through the apertures. The remaining date integers and weekday letters are masked by the spaces between the apertures and the spaces between the apertures and the edges of the spacer 14. As the calendar is rotated 90° clockwise so that side i becomes the horizontal uppermost side, the insert 12 slides downward along side l by gravity so that in FIG. 5B it fits into an angle formed by sides l and k. The distance the insert moves is equal to the distance between adjacent rows or columns of the 14×14 matrix (Center to Center). This distance is also equal to the difference in demension between a side of the void area and a side of the insert. This causes a new 31 day month display to appear through the apertures 11 wherein the first day of the month begins on Monday (M). Similarly, by rotating the device clockwise again 90° so that side l is in the uppermost horizontal position, the insert slides downward along side k to fit into the angle formed by sides k and j (not shown). A new month display is exposed in which the first day of the month begins on Tuesday (T). One more rotation of the device clockwise 90° to place side k in the uppermost horizontal position will expose another display in which the first day of the month begins on a Wednesday (W).

The reverse side of the device using side 14 of the insert can be similarly rotated in three 90° steps to display three 31 day months with the first day beginning on a Thursday (T), Friday (F) and Saturday (S), respectively.

The user of the device need only know a day of the week on which a given date of the month falls and the number of days of the month. The user rotates the device on either side to find a monthly display corresponding to the month to be displayed, and the device is set for that month. Any days between the actual number of days in a month and 31 are disregarded. When the month changes the process is again repeated using either side of the device.

Figure 6:
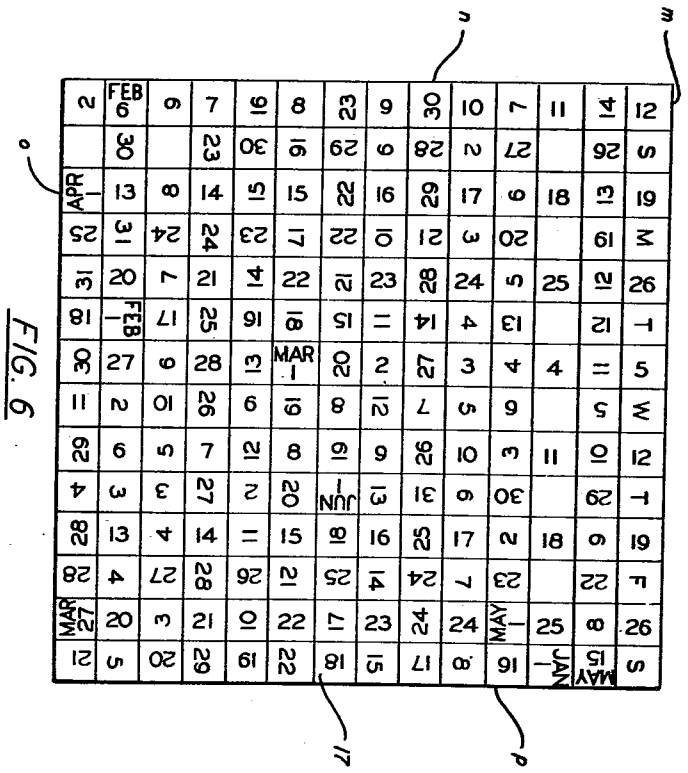
FIG. 6 shows one side of a slidable insert for a yearly calendar.
Figure 7:
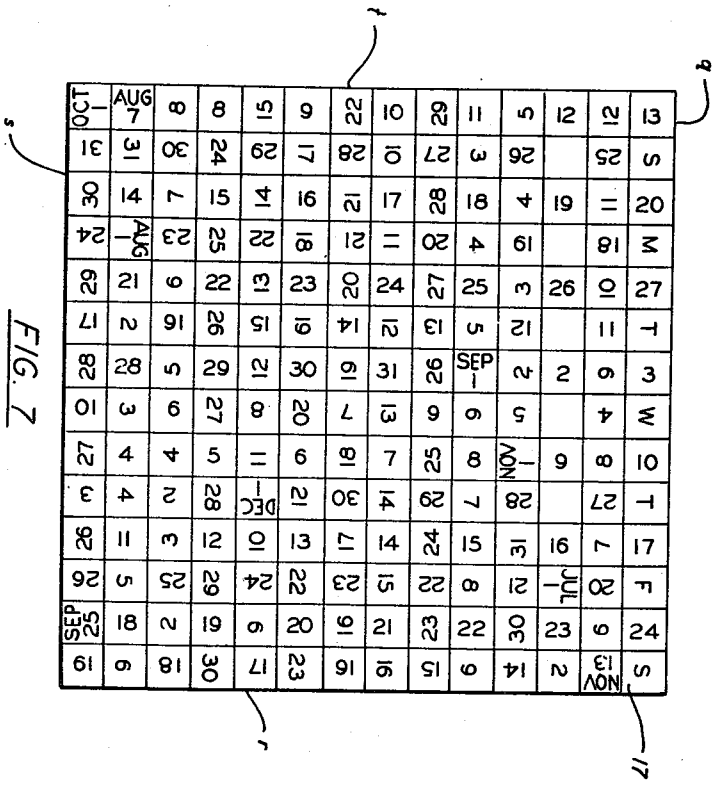
FIG. 7 shows the opposite side of the slidable insert of FIG. 6.

FIG. 6 shows one side of a yearly calendar slideable insert 17 and FIG. 7 shows the opposite side of the insert 17. The insert has the same dimensions as in the perpetual calendar insert and is slidably movable with respect to the cover members. Within the area defined by the spacer 14 the arrangement of indicia on the insert as shown in FIGS. 6 and 7 is also a 14×14 square matrix system having within it on each side, 3 distinct sets of date integers and 1 distinct set of weekday letters and date integers arranged in 7×7 matrices. However each display corresponding to a position of the device in a vertical plane with an edge uppermost and horizontal is not limited to a single 31 day month. In FIG. 6 the first set corresponding to side m in the upper horizontal position contains a row of weekday letters (S, M, T, W, T, F, S) in alternate columns of the 14×14 matrix with the first day of January beginning on a Saturday (S). Thereafter the date integers in January occupy additional rows ending with 31 under Monday (M) in row 7 of the 7×7 matrix. Thereafter the first date integer for February properly begins in the same row under T (Tuesday) and ends under S (Saturday) as February 5, to completely fill the 7×7 matrix corresponding to the set. (49 units in the matrix−7 weekday numerals=42 units remaining in the matrix minus 6 weekday letter columns not used in January=36, minus 31 days in January=5, minus 5 days in February=0). The first day of each month has the month title abbreviated over the date integer i.e. JAN. The next display corresponding to a slidable movement of the insert 90° clockwise with side n uppermost and horizontal contains a new 7×7 matrix of date integers continuing from the previous months display (February). Since the traditional calender positions of days of the week are already known, repetition of them in succeeding displays is not necessary. The date integer 6 appears at the top left hand aperture and indicates that Feb. 6 is a Sunday (S). The remaining date integers for February are arranged in the rows and columns of the distinct 7×7 matrix up to 28 integers, the number of days in February. Thereafter the first date of March, begins in the next column following 28 with MAR printed above it. The remaining rows and columns contain date integers corresponding to the dates in March until the 7×7 matrix having 49 members is occupied. The remaining dates not appearing in March are carried over to the next rotation of the device and so on until June 30 is reached in orientation p. The device is then turned over on its opposite side and insert 12 is used for displaying July as shown in FIG. 6. The arrangement on the side shown by FIG. 6 covers the period from July 1 to December 31 and also has 3 distinct 7×7 date integer matrices and 1 distinct weekday letter and date integer matrix for the month of July (orientation q, r, s and t). Thus each side of the insert covers a 6 month period.

Figure 8:
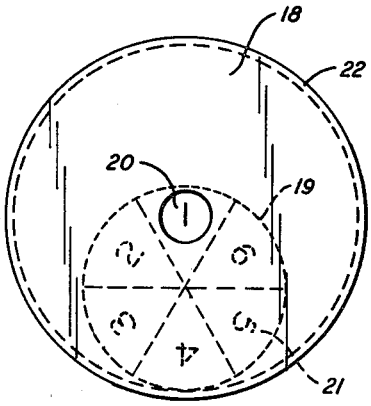

FIG. 8 shows an embodiment of the present invention in which the cover member 18 is "doughnut" shaped having a center hole 20 and the slidable insert 19 is circular. The insert 19 beneath the cover member is in the form of a circle having a smaller diameter than the cover member but larger than a straight line equal to the extension of the diameter of the inner circle or "doughnut hole" 20 to the circumference of the outer circle of the cover member. The indicia on the insert are a sequence of numbers 21. A spacer 22 defining a circular area beneath the cover member is provided. As the device is rotated the insert will slide along the circular edge of the spacer 22 by gravity and to provide a change in the registry of the indicia 21 with the aperture 20.

Figure 9:
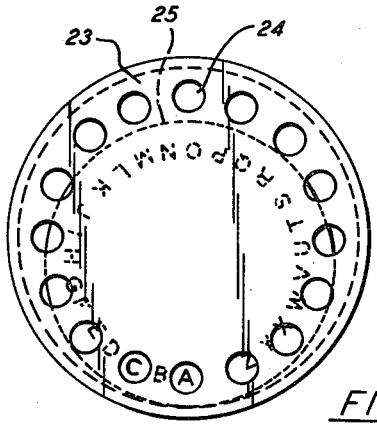
FIGS. 8 and 9 show the cover member and slidable insert of two embodiments of a display device according to the invention having a circular shape.

In FIG. 9 the cover member 21 is in the form of a circle having a plurality of circular apertures 24 around its circumference. The slidable insert 25 (dotted lines) is also in the form of a circle having a smaller diameter than the cover member 21 and has a series of indicia, i.e. letters of the alphabet on its periphery. The letters are so arranged that they will register with a lower aperture on the lower portion of the cover member as the device is rotated and will change continuously as the device is rotated again. Such a device can be used for educational purposes.

Figure 10:
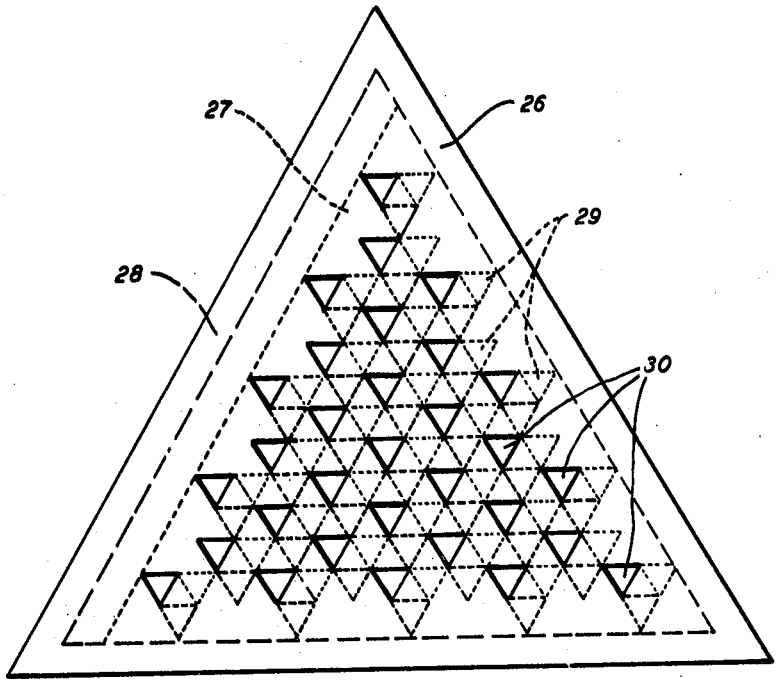
FIG. 10 shows a triangular embodiment of the present invention.

FIG. 10 shows a triangular embodiment of the present invention having a triangular cover member 26, a triangular insert 27 slidably movable by gravity within the area defined by the spacer 28. The triangular indicia 29 on the display member which can be triangular colors for example are arranged so that they will change registry with the triangular apertures 30 when the device is rotated in each of three positions in a substantially vertical plane.

Figure 11A:
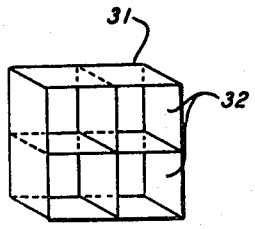
FIGS. 11A, B and C show a dimensional embodiment of the present invention useful for storing and dispensing articles.
Figure 11B:
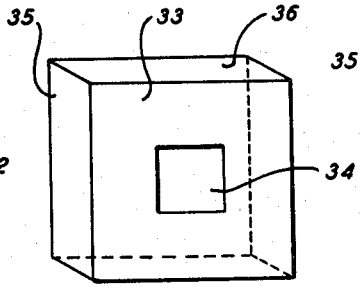
Figure 11C:
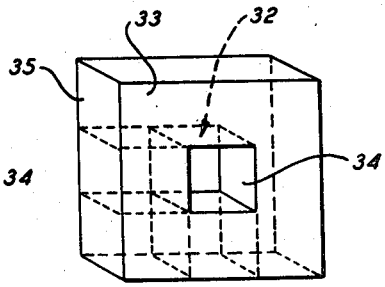

FIGS. 11A, B and C illustrate an embodiment of the present invention for storing and dispensing articles. In FIG. 11A a cubical insert 31 is shown, which insert is divided into four hollow compartments 32 for housing articles such as cigarettes, lipstick or confection. FIG. 11B shows a hollow box-like structure comprising square cover member 33 having a square aperture 34, sides 35 and second cover member 36 which may optionally also contain an aperture. The insert 31 fits between the cover members as shown by FIG. 11C with a compartment 32 of the insert in registry with the aperture 34. As the device is rotated the insert moves by gravity and another compartment registers with the aperture.

Figure 12A:
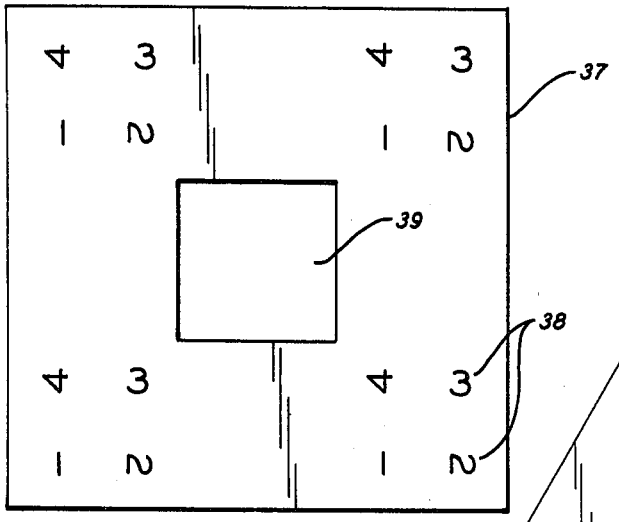
FIGS. 12A, B and C illustrate a multiple-insert display device according to the invention.

FIGS. 12A, B, and C illustrate a multiple insert embodiment of this invention.

Figure 12B:
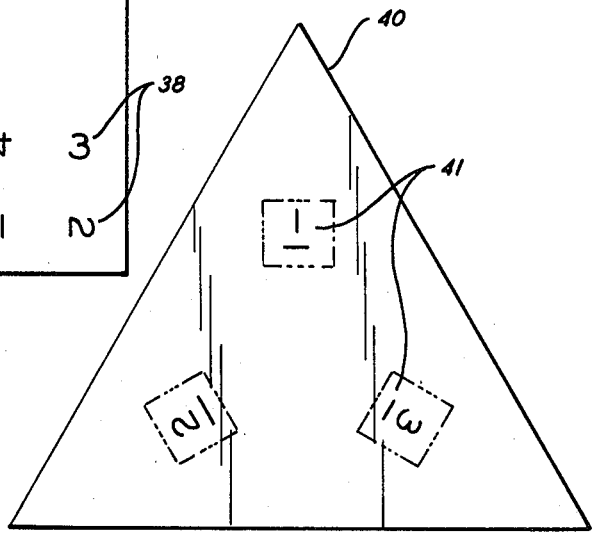
Figure 12C:
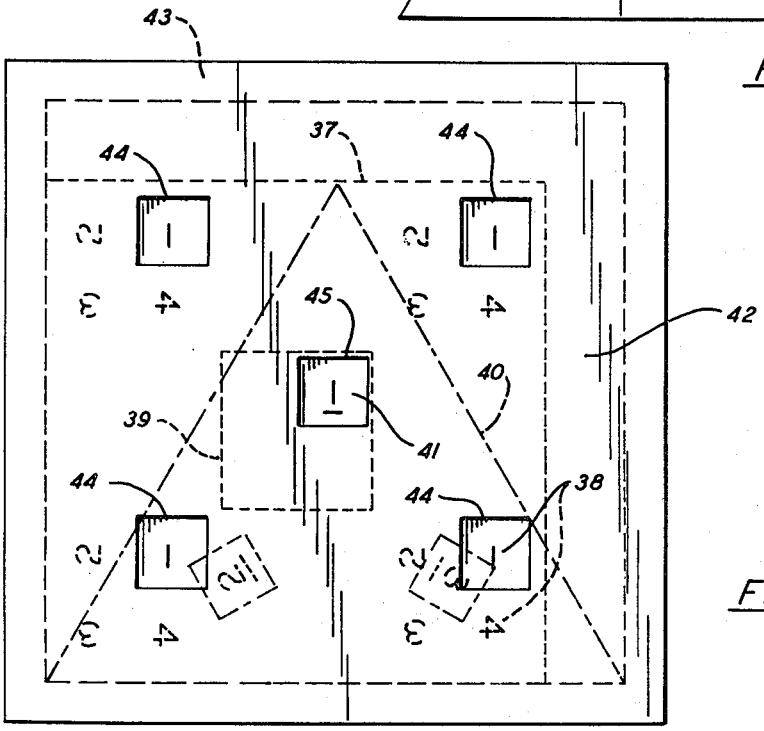

FIG. 12A shows a square insert 37 having on its surface groups of prepositioned indicia 38. In the center of the insert is a square hole 39. FIG. 12B shows a second insert 40 in the shape of a triangle and having on its surface prepositioned indicia 41. FIG. 12C shows inserts 37 and 40 in position beneath cover member 42. The dotted lines show the area in which both inserts move and is defined by a spacer 43. The cover member has four outer apertures 44 and one inner aperture 45. Insert 37 underlies the cover member 42 and insert 40 underlies insert 37. Another cover member lying under insert 40 is not shown in the Figure. Insert 37 has side dimensions less than the side dimensions of the area and is slidably movable by gravity in response to rotation of said device in a substantially vertical plane the registry of indicia 38 changing with outer apertures 44 on the cover member. A portion of the square hole 39 on the insert 37 is always in registry with inner aperture 45 of insert 37. The triangular insert 40 has side dimensions approximately equal to the side dimensions of the area defined by the spacer 43. The indicia 41 on insert 40 registers with inner aperture 45 of cover member 42 via hole 39 of insert 37 and changes registry on rotation of the device in a substantially vertical plane. Such a device is useful for educational purposes.

What is claimed is:

1. A device for displaying indicia comprising:

(a) at least one cover member of circular peripheral shape having at least one visual display means on at least one surface thereof:

(b) guide means forming a slot having a continuous circular periphery, said guide means being mounted on the cover member and said slot extending about the periphery of a predetermined area of the cover member, and (c) at least one display member having a continuous circular periphery disposed in the slot formed by the guide means and rotatably and slidably movable with respect to said cover member about the predetermined area of the cover member, said display member having a smaller area than that of said predetermined area and being adapted to roll relative to the cover member in point to point continuous contact with the continuous circular periphery of the slot extending about the predetermined area in a plane parallel to the plane of the cover member, the display member containing on its surface at least two indicia prepositioned on said display member so that each is capable of registering with said visual display means in a different predetermined angular position of said device about a substantially horizontal axis in a substantially vertical plane, said display member shifting position and rotating with respect to said cover member in point to point continuous contact with the continuous circular periphery of the slot under the force of gravity in response to rotation about the substantially horizontal axis of said device from a first angular position into a second angular position of said device in the substantially vertical plane in order to change the registry of said indicia with respect to said visual display means.

2. The device of claim 1, wherein said cover member, said display member, and said predetermined area are circular.

3. The device of claim 1, wherein said cover member is of doughnut shape.

4. The device of claim 2, wherein said visual display means comprises an aperture disposed concentrically with respect to said at least one cover member.

5. The device of claim 1, wherein said visual display means comprises at least one aperture disposed around the circumference of said cover member.

6. The device of claim 1, wherein said display member includes at least one compartment for holding an article, said indicium being the article.

7. The device according to claim 6, wherein said visual display means comprises at least one opening through said cover member sized relative to the size of said article to permit removal of said article through said opening.

8. The device according to claim 1, wherein said device comprises two display members.

9. The device according to claim 6, wherein said device comprises two display members.

10. A device for displaying articles comprising:

(a) at least one cover member having at least one light-transmitting aperture on at least one surface thereof;

(b) guide means forming a slot mounted on the cover member, said slot extending about the periphery of a predetermined area of the cover member, and (c) a display member disposed in the slot formed by the guide means and slidably movable about the predetermined area of the cover member, said display member having a smaller area than that of said predetermined area and being limited to move parallel to the inner surface of the cover member by the guide means, said display member having at least two compartments for housing articles to be displayed, a first compartment registering with said aperture in a first predetermined angular position of said device about a substantially horizontal axis in a substantially vertical plane and a second compartment registering with said aperture in a second predetermined angular position of said device about the substantially horizontal axis in the substantially vertical plane, said display member slidably shifting position by gravity with respect to said cover member within said predetermined area in response to rotation about the substantially horizontal axis of said device from said first angular position into said second angular position in the substantially vertical plane in order to change the registry of said compartments with respect to said aperture.

11. The device of claim 10, wherein said aperture is an opening through said cover member sized relative to the size of said articles to permit removal of said articles from said device through said opening.

12. The device of claim 10, wherein said cover member and said display member are of rectangular shape.

13. The device of claim 10, wherein said cover member and said display member are of triangular shape.

14. The device of claim 10, wherein said cover member and said display member are of polygonal shape.

15. The device of claim 10, wherein said cover member and said display member are of circular shape.

16. The device according to claim 10, wherein said device comprises two display members.

17. The device according to claim 11, wherein said device comprises two display members.

* * * * *